US006256616B1

(12) United States Patent
Brookner

(10) Patent No.: US 6,256,616 B1
(45) Date of Patent: Jul. 3, 2001

(54) SYSTEM FOR IDENTIFYING THE USER OF POSTAL EQUIPMENT

(75) Inventor: George Brookner, Norwalk, CT (US)

(73) Assignee: Ascom Hasler Mailing Systems Inc, Shelton, CT (US)

( * ) Notice: Subject to any disclaimer, the term of this patent is extended or adjusted under 35 U.S.C. 154(b) by 0 days.

(21) Appl. No.: 08/981,658

(22) PCT Filed: Apr. 23, 1997

(86) PCT No.: PCT/US97/06838

§ 371 Date: Dec. 22, 1997

§ 102(e) Date: Dec. 22, 1997

(87) PCT Pub. No.: WO97/40600

PCT Pub. Date: Oct. 30, 1997

Related U.S. Application Data

(60) Provisional application No. 60/015,525, filed on Apr. 23, 1996, provisional application No. 60/015,527, filed on Apr. 23, 1996, and provisional application No. 60/015,529, filed on Apr. 23, 1996.

(51) Int. Cl.[7] ..... G07B 17/00

(52) U.S. Cl. ..... 705/401; 705/60; 705/410

(58) Field of Search ..... 380/23.25; 705/401, 705/410, 60, 62

(56) References Cited

U.S. PATENT DOCUMENTS

| | | | | |
|---|---|---|---|---|
| 4,511,793 | * | 4/1985 | Racanelli | 705/404 |
| 4,779,224 | * | 10/1988 | Moseley et al. | 713/202 |
| 4,802,218 | * | 1/1989 | Wright et al. | 380/23 |
| 4,812,994 | * | 3/1989 | Taylor et al. | 705/410 |
| 4,993,068 | | 2/1991 | Piosenka et al. . | |
| 5,091,939 | * | 2/1992 | Cole et al. | 380/25 |
| 5,163,097 | * | 11/1992 | Pegg | 380/21 |
| 5,226,080 | * | 7/1993 | Cole et al. | 380/25 |
| 5,253,295 | * | 10/1993 | Saada et al. | 380/23 |
| 5,513,272 | | 4/1996 | Bogosian, Jr. . | |
| 5,615,277 | * | 3/1997 | Hoffman | 382/115 |
| 5,657,389 | * | 8/1997 | Houvener | 380/23 |
| 5,790,674 | * | 8/1998 | Houvener et al. | 380/23 |

(List continued on next page.)

FOREIGN PATENT DOCUMENTS

| | | | |
|---|---|---|---|
| 0442761 A2 | * | 8/1991 | (EP) . |
| 0911767 A2 | * | 4/1999 | (EP) . |
| WO 86/05611 | * | 9/1986 | (WO) . |
| WO 97/40600 A2 | * | 10/1997 | (WO) . |

OTHER PUBLICATIONS

Marcus et al: "HP Integrated Login. (an environment for implementing multiple security technologies)(Product Information)"; Hewlett–Packard Journal; Dec. 1995, vol. 46, no. 6, p. 34.*

Yerxa: "IMAP Servers: Delivering A Brave, New Mailbox"; Network Computing, Nov. 1, 1997, p. 90.*

*Primary Examiner*—Edward R. Cosimano
(74) *Attorney, Agent, or Firm*—Oppedahl & Larson LLP

(57) ABSTRACT

An improved system for identifying the user of postal equipment. A user provides identifying information, and if access is not appropriate based on that information, an additional comparison is performed before access is denied. This permits the user to select the identifying information needed for access from a set of predefined information, thereby permitting the user to change identifying information needed for access in the event the information has been or is suspected of having been compromised. Additional security may also be obtained by requiring the user to supply additional identifying information randomly selected from a predetermined set after valid first identifying information has been entered. Identifying information supplied by the user may include personal digital data, such as a digital fingerprint or retina eye scan.

16 Claims, 3 Drawing Sheets

U.S. PATENT DOCUMENTS 5,799,093 * 8/1998 French et al. ..... 380/51
5,841,868 * 11/1998 Helbig, Sr. ..... 235/380
5,917,913 * 6/1999 Wang ..... 380/25
5,923,762 * 7/1999 Dolan et al. ..... 380/51
5,983,273 * 11/1999 White et al. ..... 709/229
6,005,945 * 12/1999 Whitehouse ..... 380/51

* cited by examiner

SYSTEM FOR IDENTIFYING THE USER OF POSTAL EQUIPMENT

This application claims priority from provisional application Nos. 60/015,525, 60/015,527, and 60/015,529 filed Apr. 23, 1996, which applications are hereby incorporated herein by reference.

TECHNICAL FIELD

This invention is directed to a system for identifying the user of a particular device, such as postal devices, and limiting operation of such device to authorized users.

BACKGROUND ART

In countries throughout the world, a postal customer may obtain postage from the postal authority in several ways, including the purchase of stamps and the use of a postage meter. The customer has at least two security concerns no matter what method is used to obtain postage from the postal authority. First, the customer is concerned that only his authorized agents purchase postage from the postal authority. Second, the customer is concerned with limiting usage of the purchased postage to authorized persons. This is a particular concern in an office environment where there are a large number of personnel.

When stamps are involved, their purchase may be controlled through various accounting techniques, and their use is generally limited by physically controlling the stamps themselves. For example, the stamps are kept in a locked location, such as a drawer, and only authorized personnel have access to the stamps. Such physical controls may also be used for limiting access to postage machines. Due to the size of postage machines, however, such physical control mechanisms may be of great inconvenience.

Typically, a postage meter is left out in an open area where there is little access control to the physical area itself. Thus, limiting the operation of the machine must be accomplished in a manner in which it is not necessary to limit access to the area containing the machine. In some postage machines, limiting operation to authorized personnel has been accomplished through use of physical means, most typically a key without which the machine will not operate. Physical controls similar to those used for stamps are then used to limit access to the key to authorized personnel.

With electronic postage meters, it may be possible to limit operation of the machine to authorized personnel through the use of a Personal Identification Number (PIN), in addition to physical controls, or in combination therewith. Furthermore, some electronic postage meters are capable of purchasing postage remotely, obviating the necessity of physically taking the postage meter to the postal authority for the addition of postage, and a PIN may be used to limit those persons who are authorized to purchase additional postage. When a PIN is involved, however, there is a risk that some unauthorized person may obtain knowledge of the PIN, for example, by observing the entry of the PIN by an authorized person. When the PIN becomes compromised, or knowledge of it is no longer limited to authorized personnel, the PIN ceases to be an effective means of limiting the operation of the postage meter to authorized personnel.

When a PIN has been compromised, or is suspected of having been compromised, the PIN must be changed in order to once again become an effective means of limiting the operation of the postage meter to authorized personnel. Changing a PIN, however, is not a trivial matter. Generally, the supplier of the postage meter must be consulted, which at a minimum, increases the amount of time the compromised PIN is no longer an effective control means.

DISCLOSURE OF THE INVENTION

In accordance with the present invention, there is provided a greatly improved system for user identification of postal equipment in connection with the use of an access device. According to the invention, it is provided that the access device may be associated with a number of access codes, or Personal Identification Numbers (PINs), and the active code may be selected at the user's discretion. Additional security may also be provided for by prompting for additional information randomly selected from a predetermined set after the entry of a valid PIN. In keeping with the invention, data supplied by the user used to identify the user may include biometric personal digital data, such as a digital fingerprint, voice pattern or a retina eye scan.

MODES FOR CARRYING OUT THE INVENTION

Figure 1:
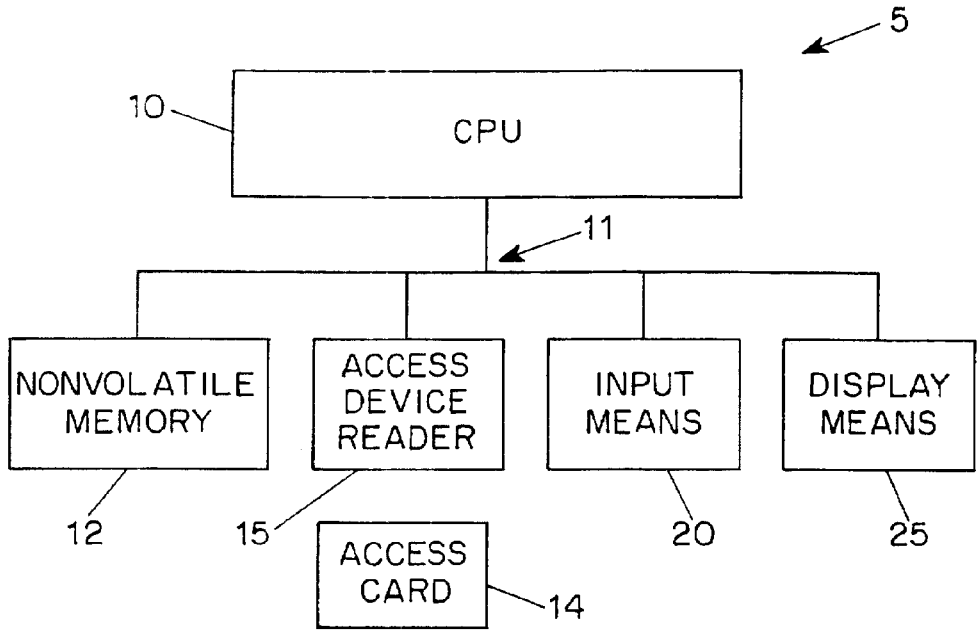
FIG. 1 is a block diagram of the system of the present invention used with a postage meter.

Referring to FIG. 1, a user identifying system is shown generally at 5 and includes a CPU 10, nonvolatile memory 12, an access device 14, an access device reader 15, input means 20, and display means 25, wherein CPU 10, access device reader 15, input means 20, and display means 25 are coupled with each other by system bus 11. Such a system may be integrated into postal equipment, for example by using the components of the postal equipment, or may be a stand alone system connected for controlling the postal equipment.

When access device 14 is inserted into access device reader 15, CPU 10 prompts the user by means of display means 25 to enter an input through input means 20. The access device may be a card with magnetically encoded information., or a "smart card," or the like. The CPU 10 then compares the user input with either a value previously encoded on the access device 14 or contained within nonvolatile memory 12, or both, which are related to the user indicated by access device 14. If the user input matches one or both of the other values, as previously selected, user identity is verified and access to the postal equipment is permitted.

Figure 2:
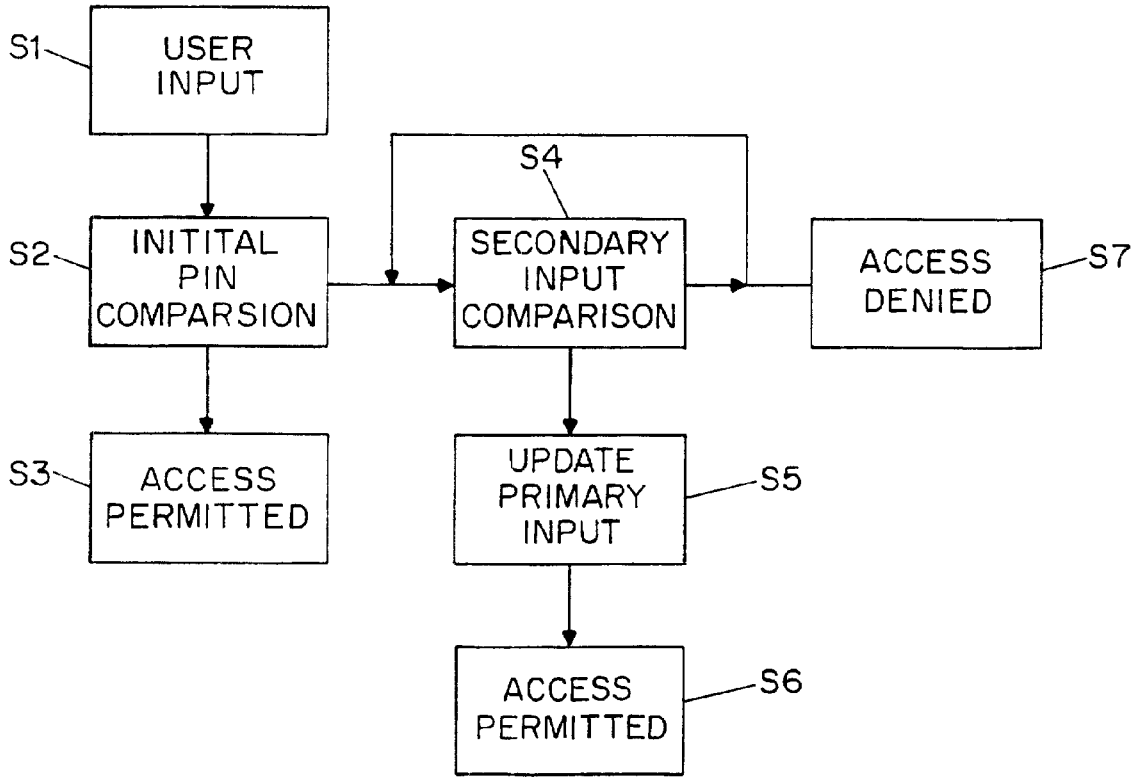
FIG. 2 is a flow chart of the user identification method according to the invention.

Referring now to FIG. 2, a flow chart is shown wherein the identification is based upon a predetermined number of PINs, and the active PIN is changeable by the user at the user's discretion. When the CPU 10 in the user identifying system 5 shown in FIG. 1 referred to above, compares the user inputs (S1) with one or both of the other values (S2), as previuosly selected, and there is a math with the user input, access is permitted (S3). When the CPU 10 in the user identifying system 5 shown in FIG. 1 referred to above, compares the user input (S1) with one or both of the other values (S2), as previously selected, and there is no match with the user input, a secondary comparison (S4) is performed against secondary values contained in at least memory 12 of access control'system 5. This secondary comparison is performed until a match is found, or the number of permissible secondary values has been exceed and no match has been found. If the secondary comparison results in no match (S7), the user is not permitted to access the postal equipment. If, however, a match is found (S5), the memory 12 or access device 14, or both, are updated to note the new value, and alternatively, it is indicated the old value may not be used in the future, and the user is permitted to access the postage device (S6).

In this embodiment, a number of PINs are allocated to a user's access device at the time of creation. These PINs are now forevermore linked to the specific user and the user identification system. This invention which allows the user to select among the PINs assigned to the user's access device provides the same type of access security as issuing a new access device.

The number of PINS preassigned is only limited to the number a user can remember (by memory, written, logged, etc.), but would typically be more than one. Should a user decide to change his/her PIN, any of the preassigned PINs are valid. Once a new PIN is used for the first time, the user identity system recognizes this PIN is one of the preassigned PINs and will now expect this new PIN to be the standard PIN for this user. Once the last preassigned PIN has been selected, the PIN may no longer be changed by the user.

If one of the user's access devices is lost, stolen, or misplaced, the meter manufacturer may supply a replacement access device and the user may immediately change the PIN. If the lost access device is found, it is still valid with the new PIN. If the access device was stolen, it is useless. Further, this system permits the vendor of the postal equipment the option of asking the user to change the active PIN, due to some reason of security. Thus, this is effectively the same as issuing a new access device without the costs or logistics involved with new issues.

Figure 3:
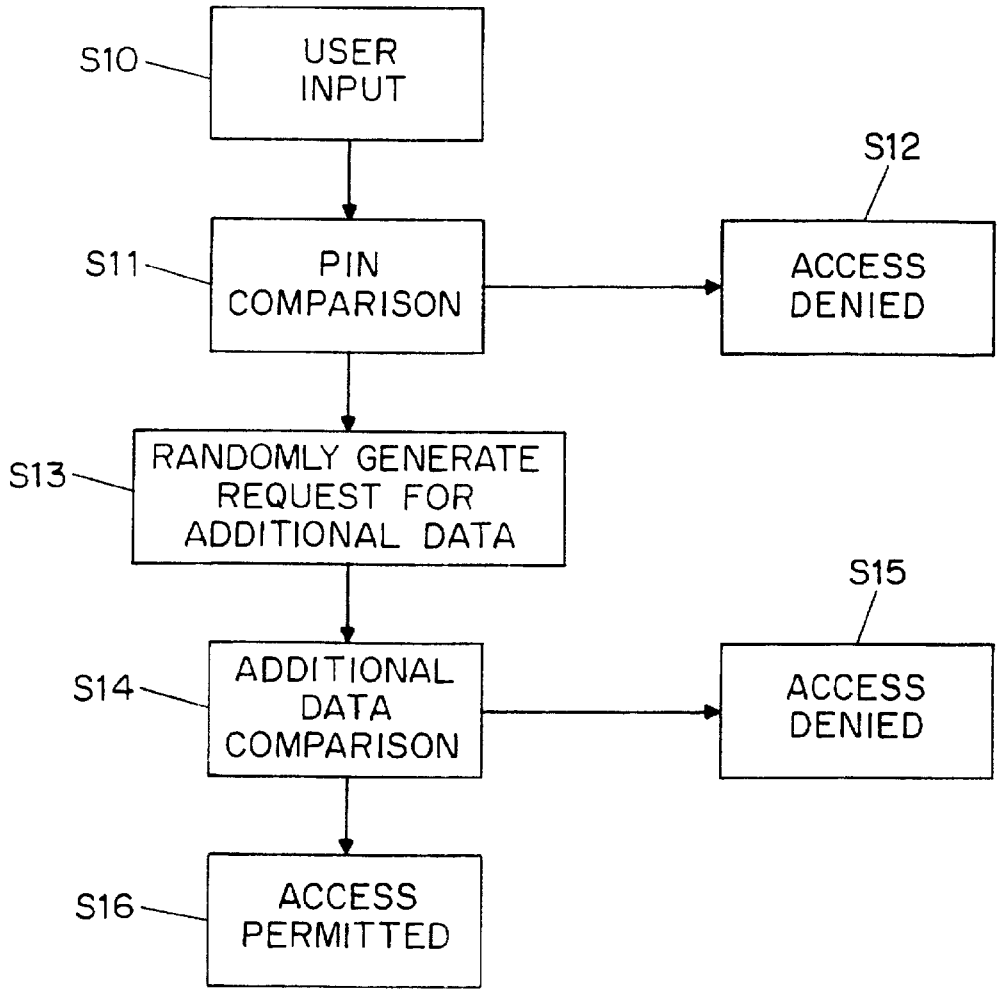
FIG. 3 is a flow chart of the user identification method according to another embodiment of the invention.

Referring now to FIG. 3, a flow chart is shown wherein the identification is based upon providing additional information randomly selected from a predetermined set after entry of a valid PIN. When the CPU 10 in the user identification system 5 shown in FIG. 1 referred to above, compares the user input (S10) with one or both of the other values (S11), as previously selected, and there is no match with the user input (S12), the user is not permitted to access the postage meter. If there is a match, however, the CPU 10 prompts the user to enter additional information randomly selected from a pre-selected amount of information contained in memory 12 (S13). Such additional information may be in the nature of "birth date," "Social Security No.," "Address," other unique user-specific data, or the like. This additional information will be doubled, tripled, etc., such that the request for additional information will not be the same for each use of the access device.

It is preferred the prompt for additional information alternate (randomly or sequentially) amongst the additional values contained in memory 12. If the secondary comparison (S14) results in no match (S15), the user is not permitted to access the postage meter; if it results in a match (S16), access is permitted. This method of verifying user identity minimizes the possibility of an access device 14 or security code being fraudulently obtained and then used. This embodiment of the invention may be used with an access device only having the possibility of one PIN, or with an access device capable of having multiple PINs, as is shown in FIG. 2.; it may also be used in connection with the initial access code.

Figure 4:
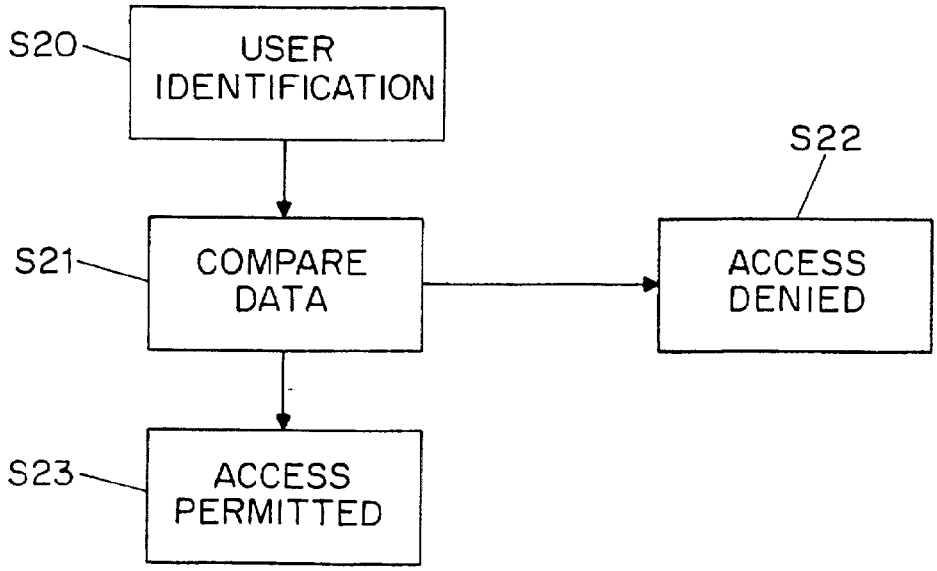
FIG. 4 is a flow chart of the user identification method according to another embodiment of the invention.

Referring now to FIG. 4, a flow chart is shown wherein the identification is based upon providing some unique personal digital data, or biometric, such as a digital finger print, voice pattern or retina eye scan. When the CPU 10 in the user identification system 5 shown in FIG. 1 referred to above, compares the user input (S20) with one or both of the other values (S21), as previously selected, and there is no match with the user input (S22), the user is not permitted to access the postage meter. If there is a match (S23), access is permitted.

In this embodiment, the user input consists of the user's digital finger print, voice pattern or retina eye scan. If the identify verification process is a closed loop process-between the user, the access device 14 and the CPU 10, then the personal digital data can be compared against the value in the access device 14 and in turn the value in memory 12. Alternatively, the comparison may be only against the value in the access device 14. Further, the comparison may be only against the value in memory 12 if the access device is restricted in band pass, memory, or the like. The level of security desired may relate to the magnitude of biometric data comparison necessary in that a low level of security could command an abbreviated biometric data comparison (e.g., major finger print classification features), while high levels of security would command a comprehensive "all features" evaluation of the data. In a small office environment, the biometric data comparison requirements could be reduced to only several unique finger print, voice pattern or retina scan features or the like. In such a configuration, the time to verify would be rapid and the identity data content would be small.

This embodiment eliminates the present need for a series of user commands or interactive network commands to validate the use of franking/postage equipment. By utilizing the personal digital data, it is no longer necessary to additionally validate the related equipment to be used for franking/postage processing. Rather, the personalized digital data is predefined for the system to which the user is authorized. Furthermore, the input means 20 may be contained in access device 14.

Figure 5:
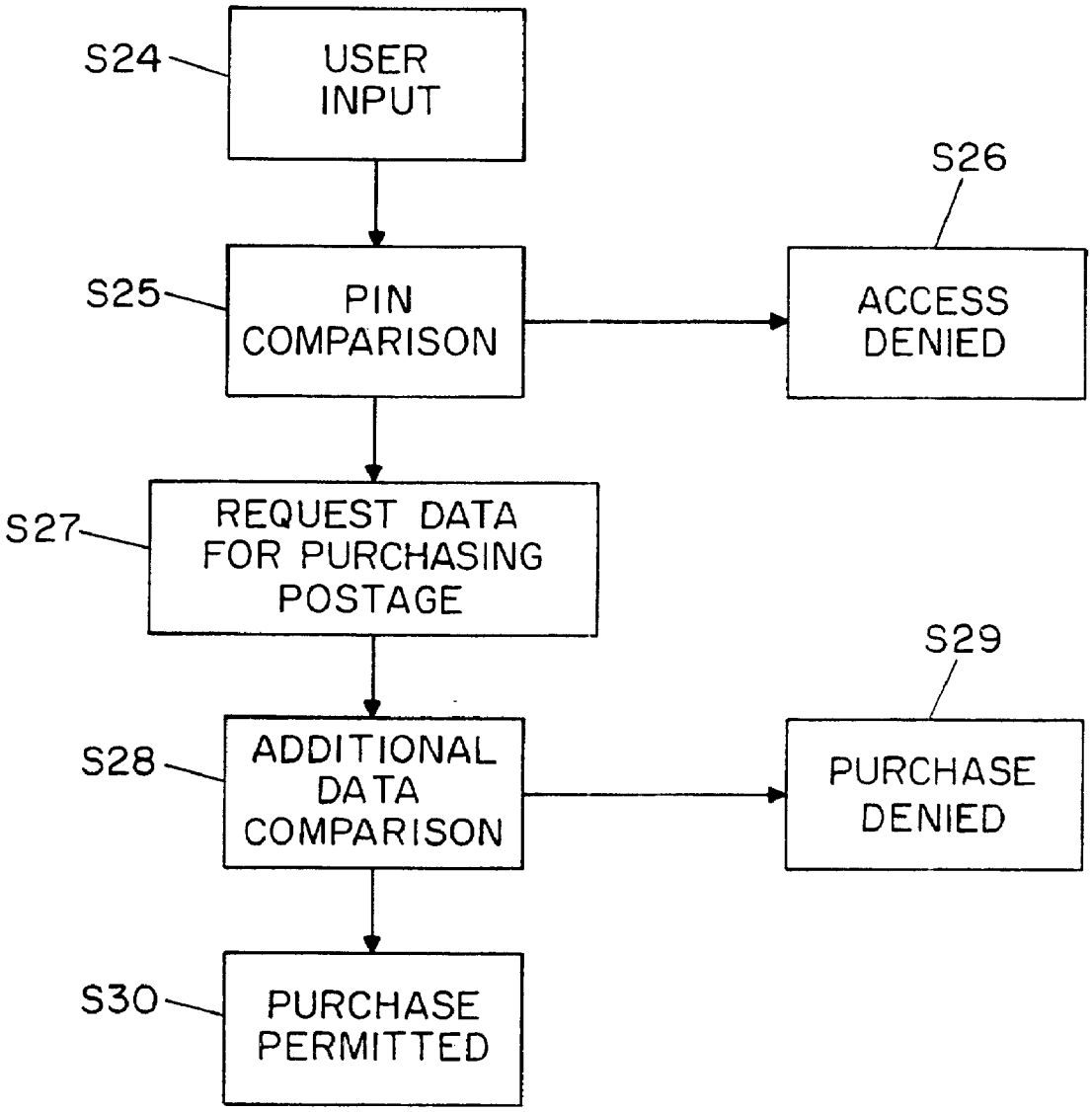
FIG. 5 is a flow chart of the user identification method according to another embodiment of the invention.

Referring now to FIG. 5, a flow chart is shown wherein the present invention is used in connection with the remote purchasing of postage. Telemeter setting (TMS) may be carried out as set forth in EPO pub. no. EP 442761, or as set forth in PCT pub. no. WO 86-05611, each of which is incorporated herein by reference. Once CPU in the user identification system 5 shown in FIG. 1 referred to above, compares the user input (S24) with the possible values (S25), and there is no match with the user input (S24), the user is not permitted to access the postage meter (S26). The user input may be textual, biometric, or another type of data. If there is a match, however, the TMS Data Center requests additional data (S27) to determine (S28) if the user is authorized to purchase postage. Such additional data may be either textual, biometric, or randomly selected in accordance with the present invention. If there is no match (S28) between the additional data and that maintained by the Data Center, the purchase does not proceed (S29), if there is a match, the purchase proceeds (S30).

While there have been described what are believed to be the preferred embodiments of the invention, those skilled in the art will recognize that other and further modifications may be made thereto without departing from the invention and it is intended to claim all such changes and modifications as fully within the scope of the invention.

I claim:

1. A system, comprising:

input means for receiving user supplied information from a user of postal equipment;

means for storing in advance a plurality of data associated with said user, one such datum being the preferred stored data and a second such datum being the secondatv stored data;

means responsive to said input means for:

comparing said user supplied information against said stored data, including, but not necessarily limited to, said preferred stored data and said secondary stored data;

updating said preferred stored data to be said secondary stored data, if, when said comparison was made, said user supplied information was in a predefined relationship with said secondary stored data.

2. The system as described in claim 1, additionally comprising:

means responsive to said input means for permitting said user to access said postal equipment if, when said comparison was made, said user supplied information was in said predefined relationship with said secondary stored data.

3. The system as described in claim 1, wherein said user supplied data includes said user's digital finger print or retina eye scan.

4. A system for verifying the user of postal equipment, comprising:

input means for input of information, said information including data associated with a user of said system;

means for storing a plurality of data associated with said user;

means for prompting the user to input one of the plurality of data associated with said user, said data being randomly selected;

means responsive to said input means for:

receiving said user identifying data;

comparing said user identifying data to said randomly selected stored data associated with said user;

permitting said user to access said postal equipment if said user identifying data is in a predefined relationship with said randomly selected stored data.

5. A system for verifying the user of postal equipment, comprising:

input means for input of information, said information including first data associated with a user of said system;

means for storing a plurality of data associated with said user;

means responsive to said input means for:

receiving said user identifying first data;

comparing said user identifying first data against said stored data;

means for prompting the user to input user identifying second data that is one of the plurality of data associated with said user, said user identifying second data being randomly selected;

means for input of said user identifying second data;

means responsive to said input means for:

receiving said user identifying second data;

comparing said user identifying second data against said randomly selected stored data associated with said user;

permitting said user to access said postal equipment if said user identifying second data is in a predefined relationship to said randomly selected stored data.

6. A method, comprising the following steps:

(a) obtaining first user identifying information from an access device provided by a user of postage equipment;

(b) prompting the user to enter second identifying information;

(c) comparing said user supplied second identifying information against primary identifying information previously associated with said first user identifying information;

(d) comparing said user supplied second identifying information against secondary identifying information previously associated with said first user identifying information;

(e) updating said primary identifying information from said secondary identifying information, if, when said comparison was made, said user supplied second identifying information was in a predefined relationship with said secondary identifying information.

7. The method as described in claim 6, wherein said user supplied second identifying data includes a user's digital finger print.

8. The method as described in claim 6, wherein said user supplied second identifying data includes a user's voice pattern.

9. The method as described in claim 6, wherein said user supplied second identifying data includes a user's retina eye scan.

10. A method of verifying the identity of a user of postal equipment, comprising the following steps:

(a) obtaining first user identifying information from an access device provided by the user;

(b) prompting the user to enter second user identifying information;

(c) obtaining user supplied second identifying information from the user;

(d) comparing said user supplied second identifying information against second user identifying information previously associated with said first user identifying information;

(e) prompting the user to enter third user identifying information randomly selected from a set of information previously associated with said first user identifying information;

(f) obtaining user supplied third identifying information from the user;

(g) comparing said user supplied third identifying information to said randomly selected third user identifying information;

(h) permitting the user to access said postal equipment if (i) said user supplied second identifying information is in a first predefined relationship with said second user identifying information and (ii) said user supplied third identifying information is in a second predefined relationship with said randomly selected third user identifying information.

11. The method as described in claim 10, wherein said user supplied second identifying information includes a user's digital finger print.

12. The method as described in claim 10, wherein said user supplied second identifying information includes a user's voice pattern.

13. The method as described in claim 10, wherein said user supplied second identifying information includes a user's retina eye scan.

14. A method of verifying the identity of a user of postal equipment, comprising the following steps:

(a) obtaining first user identifying information from an access device provided by the user;

(b) prompting the user to enter second identifying information;

(c) comparing said user supplied second identifying information against both stored second identifying information previously associated with said first user identifying information and stored alternate identifying information previously associated with said first user identifying information;

(d) obtaining third identifying information from the user;

(e) comparing said user supplied third identifying information against stored third identifying information previously associated with said first user identifying information;

(f) permitting the user to access said postal equipment and updating said stored second identifying information to be said stored alternate identifying information, if said user supplied second identifying information is in a first predefined relationship with said stored alternate identifying information and (iii) said user supplied third identifying information is in a second predefined relationship with said stored third identifying information.

15. The method described in claim 14, wherein said third identifying information is biometric data.

16. A method of verifying the identity of a user of postal equipments comprising the following steps:

(a) obtaining first user identifying information from an access device provided by the user;

(b) prompting the user to enter second identifying information;

(c) comparing said user supplied second identifying information against stored second identifying information previously associated with said first user identifying information;

(d) obtaining third identifying information from the user, said third identifying information being requested from the user by random selection from a set of information previously associated with said first user identifying information;

(e) comparing said user supplied third identifying information against stored third identifying information previously associated with said first user identifying information;

(f) permitting the user to access said postal equipment, if said user supplied third identifying information is in a predefined relationship with said stored third identifying information.

* * * * *